US008449080B2

(12) United States Patent
Shibata et al.

(10) Patent No.: US 8,449,080 B2
(45) Date of Patent: May 28, 2013

(54) BASE FOR LIQUID DISCHARGE HEAD, AND LIQUID DISCHARGE HEAD USING THE SAME

(75) Inventors: Kazuaki Shibata, Yokohama (JP); Ichiro Saito, Yokohama (JP); Takahiro Matsui, Yokohama (JP); Teruo Ozaki, Yokohama (JP); Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 605 days.

(21) Appl. No.: 12/680,776

(22) PCT Filed: Nov. 27, 2008

(86) PCT No.: PCT/JP2008/071994

§ 371 (c)(1),
(2), (4) Date: Mar. 30, 2010

(87) PCT Pub. No.: WO2009/075214

PCT Pub. Date: Jun. 18, 2009

(65) Prior Publication Data

US 2010/0220154 A1 Sep. 2, 2010

(30) Foreign Application Priority Data

Dec. 12, 2007 (JP) ..... 2007-320954

(51) Int. Cl.
*B41J 2/05* (2006.01)

(52) U.S. Cl.
USPC ..... 347/65; 347/61

(58) Field of Classification Search
USPC ..... 347/61–65
See application file for complete search history.

(56) References Cited

U.S. PATENT DOCUMENTS

| | | | | |
|---|---|---|---|---|
| 4,860,033 | A | 8/1989 | Shiozaki et al. | |
| 5,478,606 | A | 12/1995 | Ohkuma et al. | |
| 5,485,185 | A | 1/1996 | Sueoka et al. | |
| 5,491,505 | A | 2/1996 | Suzuki et al. | |
| 6,315,853 | B1 | 11/2001 | Kubota et al. | |
| 6,402,302 | B1 | 6/2002 | Ozaki et al. | |
| 6,540,330 | B1 | 4/2003 | Kubota et al. | |
| 6,578,951 | B2 | 6/2003 | Ozaki et al. | |
| 6,609,783 | B1 | 8/2003 | Koyama et al. | |
| 7,117,597 | B2 * | 10/2006 | Nishida | 29/890.1 |
| 7,306,327 | B2 | 12/2007 | Sakai et al. | |

(Continued)

FOREIGN PATENT DOCUMENTS

| | | | |
|---|---|---|---|
| CN | 1732086 | A | 2/2006 |
| JP | 2003-145767 | A | 5/2003 |
| JP | 2004-216875 | A | 8/2004 |

OTHER PUBLICATIONS

Office Action dated Mar. 23, 2012, in Chinese Appln. No. 200880120120.8.

*Primary Examiner* — Kevin S Wood
(74) *Attorney, Agent, or Firm* — Fitzpatrick, Cella, Harper & Scinto

(57) ABSTRACT

A base for a liquid discharge head includes a heat element which forms an exothermic portion, an electrode wire that is electrically connected with the heat element, an insulative protective layer provided above the heat generating resistive element and the electrode wire and an upper protective layer provided on the protective layer. The upper protective layer is made from a TaSi alloy containing 22 at. % or more Si.

10 Claims, 8 Drawing Sheets

U.S. PATENT DOCUMENTS

| | | | |
|---|---|---|---|
| 7,393,084 | B2 | 7/2008 | Saito et al. |
| 7,641,316 | B2 | 1/2010 | Sakai et al. |
| 7,681,993 | B2 | 3/2010 | Ono et al. |
| 7,712,875 | B2 | 5/2010 | Shibata et al. |
| 2008/0151007 | A1 | 6/2008 | Kozuka et al. |
| 2009/0040264 | A1 | 2/2009 | Hatsui et al. |
| 2009/0315954 | A1 | 12/2009 | Sakurai et al. |
| 2009/0315956 | A1 | 12/2009 | Ishida et al. |

* cited by examiner

BASE FOR LIQUID DISCHARGE HEAD, AND LIQUID DISCHARGE HEAD USING THE SAME

TECHNICAL FIELD

The present invention relates to a base for a liquid discharge head which records a letter, a mark, an image, a pattern or the like by discharging a liquid (functional liquid such as ink, for instance) onto a recording medium such as a paper, a plastic sheet, a fabric and the like, and to a liquid discharge head using the base.

BACKGROUND ART

A general structure of a head to be used for a liquid discharge recording includes a structure having a plurality of discharge ports, a flow path which communicates with the discharge ports, and a plurality of heat generating resistive elements for generating thermal energy used for discharging a liquid. The heat generating resistive element is structured so as to have a heat generating resistive element and an electrode for supplying an electric power to the heat generating resistive element. Insulation properties between each heat generating resistive element are secured by covering the heat generating resistive elements with an insulation film. The discharge port and an opposite end of each liquid flow path are communicated with a common liquid chamber, and a liquid is stored in the common liquid chamber, which is supplied from a liquid tank of a liquid-storing section. The liquid which has been supplied to the common liquid chamber is introduced into each liquid flow path from the common liquid chamber, and is retained in the vicinity of the discharge port in a state of forming a meniscus. The liquid discharge head selectively drives the heat generating resistive element in the state, rapidly heats and bubbles a liquid on a thermal action face by using thereby generated thermal energy, and discharges the liquid by using the pressure according to the change of the state.

When the liquid is discharged, the thermal action portion of the liquid discharge head is exposed to high temperature due to heat generated by the heat generating resistive element, and results in receiving a cavitation impact due to the bubbling and retraction of the liquid in combination with a chemical action by the liquid.

Therefore, an upper protective layer is usually provided on the thermal action portion so as to protect the heat generating resistive element from the cavitation impact and the chemical action by the liquid.

A method for manufacturing a liquid discharge head using the base for a head, which has such an upper protective layer formed thereon, is disclosed in U.S. Pat. No. 5,478,606, for instance.

Conventionally, a Ta film which is comparatively resistant to the cavitation impact and the chemical action by the liquid has been formed on the surface of the thermal action portion into a thickness of 0.2 to 0.5 μm as the upper protective layer, in order to balance the lifetime of the head with the reliability.

On these thermal action portions, such a phenomenon has occurred that a color material, an additive or the like contained in the liquid is decomposed into a molecular level by being heated at high temperature, is changed into a substance having poor solubility, and is physically absorbed onto the upper protective layer. This phenomenon is referred to as kogation.

When an organic substance and an inorganic substance having poor solubility are absorbed on the upper protective layer in this way, thermal conductance to the liquid from the heat generating resistive element becomes ununiform, and the liquid is bubbled unstably. For this reason, a Ta film is generally used which causes comparatively little kogation thereon and is an adequate film.

A behavior of the liquid in relation with bubbling and debubbling on a thermal action portion is described with reference to FIG. 7. FIG. 7 is a view for describing a temperature change of an upper protective layer and a state of bubbling occurring after voltage has been applied.

A curve (a) of FIG. 7 shows a change of a surface temperature of the upper protective layer with time occurring after the moment when voltage has been applied to a heat generating resistive element in driving conditions of driving voltage ($V_{op}$): $1.3 \times V_{th}$ ($V_{th}$: bubbling threshold voltage of liquid), driving frequency: 6 kHz, and pulse width: 5 μs. In addition, a curve (b) similarly shows a growing state of a bubble occurring after the moment when the voltage has been applied to the heat generating resistive element.

As is shown in the curve (a), the temperature starts to increase after the voltage has been applied, reaches a peak of the temperature slightly later than a predetermined pulse time which has been set (because heat from the heat generating resistive element reaches to the upper protective layer slightly later), and afterwards decreases mainly through thermal diffusion. On the other hand, as shown in the curve (b), the bubble starts growing when the temperature of the upper protective layer approaches about 300° C., and debubbles after having reached the maximum bubbling state. In an actual liquid discharge head, the above process is repeated. Thus, the surface of the upper protective layer increases, for instance, to approximately 600° C. along with the bubbling of the liquid, and it is understood that liquid discharge recording is carried out along with a thermal action of very high temperature.

Accordingly, an upper protective layer which contacts the liquid is required to have film characteristics superior in heat resistance, mechanical properties, chemical stability, oxidation resistance, alkali resistance and the like. A noble metal, a high-melting transition metal or the like in addition to the above Ta film is used as a material to be used in the upper protective layer.

However, in recent years, higher functions such as high image quality and high speed record are further demanded to the liquid discharge recording. In order to satisfy these demands, the liquid discharge recording is required to improve an ink performance, for instance, color developing properties and weathering resistance so as to cope with the tendency of higher image quality, and to prevent bleeding (bleed between different color inks) so as to cope with a high-speed recording. Then, in order to satisfy these requirements, such attempts have been made as to add various components into an ink. In addition, a type of ink itself is diversified. For instance, inks of a pale color having a thinned concentration in addition to black, yellow, magenta and cyan are used. Even a Ta film which has been conventionally considered to have stability against these inks as the upper protective layer causes a phenomenon of corrosion due to a thermochemical reaction with the inks. The phenomenon remarkably appears when the used ink contains, for instance, a salt of a bivalent metal such as Ca and Mg, or a component of forming a chelate complex.

On the other hand, when a formed upper protective layer has an improved corrosion resistance against the ink as described above, the upper protective layer shows high corrosion resistance, but on the contrary, tends to easily cause kogation because the surface is little damaged. Thereby, the discharge speed of the ink decreases and becomes unstable.

Incidentally, the reason why a conventionally used Ta film causes little kogation is because the occurrences of the slight corrosion of the Ta film and the kogation are well balanced. The reason is assumed to be because when the surface of the Ta film is scraped off by the corrosion, the deposits of products originating from the kogation are also removed from the surface of the Ta film, at the same time.

In order to further increase the speed of the liquid discharge recording, it is necessary to drive the liquid discharge head by increasing a driving frequency in comparison with a conventional one and using a shorter pulse. When the head is driven by such a short pulse, cycles of heating→bubbling→debubbling→cooling are repeated on a thermal action portion of the head in a short period of time, so that the thermal action portion receives more thermal stresses in a shorter period of time than the conventional one. When the head is driven by the short pulse, a cavitation impact originating from the bubbling and retraction of the ink is also concentrated on the upper protective layer in a shorter period of time than the conventional one. Therefore, the upper protective layer needs to have superior mechanical impact characteristics.

As for such an upper protective layer, U.S. Pat. No. 7,306,327 discloses a base for a liquid discharge head using a TaCr alloy of an amorphous structure including 12 at. % or more Cr.

In addition, U.S. Pat. No. 7,306,327 discloses a base for a liquid discharge head, which uses a TaCr alloy of an amorphous structure including 30 at. % or less Cr, because the alloy is easily patterned with a dry etching technique.

However, as the tendency of recording a recording image at a higher speed progresses recently, it is considered that a base for a liquid discharge head will be lengthened (into 1.0 inch or longer in particular), and that an ink containing an additive for enhancing the light resistance and gas resistance of the ink will be adopted. In this case, the stress or the like of a resin layer which forms a wall of a liquid flow path and a discharge port may cause distortion due to a difference of a linear expansion coefficient among the structural members of the head, and a component of a new ink may give influence to the interface between the structural members. From the above factors, it might happen that the flow path forming member made from a resin, which forms the wall of the liquid flow path and the discharge port is peeled from an upper protective layer on a silicon substrate. It was also likely to happen that even though an adhesion layer made from an organic substance would be provided on the upper protective layer so as to enhance the adhesiveness between the member and the layer, the upper protective layer is peeled from the adhesion layer in the vicinity of the interface between the layers, the ink infiltrates into a substrate side from the protective layer, and consequently causes the corrosion of wiring. As a result, it was likely to happen that an adequate recording is not obtained, and that quality reliability is difficult to be secured over a long period of time.

In other words, when the base had a size of 0.5 inches or more and less than 1.0 inch, the adhesiveness was adequate between a TaCr film and an adhesion layer of an organic substance disclosed in U.S. Pat. No. 5,478,606. However, a substrate of a lengthened recording device having a base size of 1 inch or more is required to have an upper protective layer therein which has a further enhanced adhesiveness.

As is disclosed in U.S. Pat. No. 7,306,327, when the TaCr film is patterned with a generally used dry etching technique, the etching rate depends on a Cr content, and decreases as the Cr content increases.

DISCLOSURE OF THE INVENTION

Under the circumstances, the present invention has been designed with respect to the above described problem, and is directed at providing a base for a liquid discharge head, which can provide quality reliability over a long period of time by improving adhesiveness between an upper protective layer having a portion contacting an ink of the base for the liquid discharge head and a resin layer. In addition, the present invention is directed at providing a liquid discharge head using such a base for a liquid discharge head.

In order to solve the above described object, a base for a liquid discharge head having a flow path forming member made from a resin provided thereon, which includes a heat generating resistive element for generating energy for discharging a liquid, an electrode wire that is electrically connected with the heat generating resistive element, an insulative protective layer provided above the heat generating resistive element and the electrode wire, and an upper protective layer provided above the insulative protective layer, characterized in that the upper protective layer is made from a TaSi alloy containing 22 at. % or more Si.

A liquid discharge head according to the present invention is characterized in that a flow path forming member having a discharge port is formed on the above described base for the liquid discharge head.

The present invention can provide a base for a liquid discharge head which improves adhesiveness between an upper protective layer having a portion contacting an ink of the base for the liquid discharge head and a resin layer, and which can provide quality reliability over a long period of time, and a liquid discharge head using the base for the liquid discharge head.

Further features of the present invention will become apparent from the following description of exemplary embodiments with reference to the attached drawings.

BEST MODE FOR CARRYING OUT THE INVENTION

Embodiments according to the present invention will now be described with reference to the drawings or the like.

Figure 1:
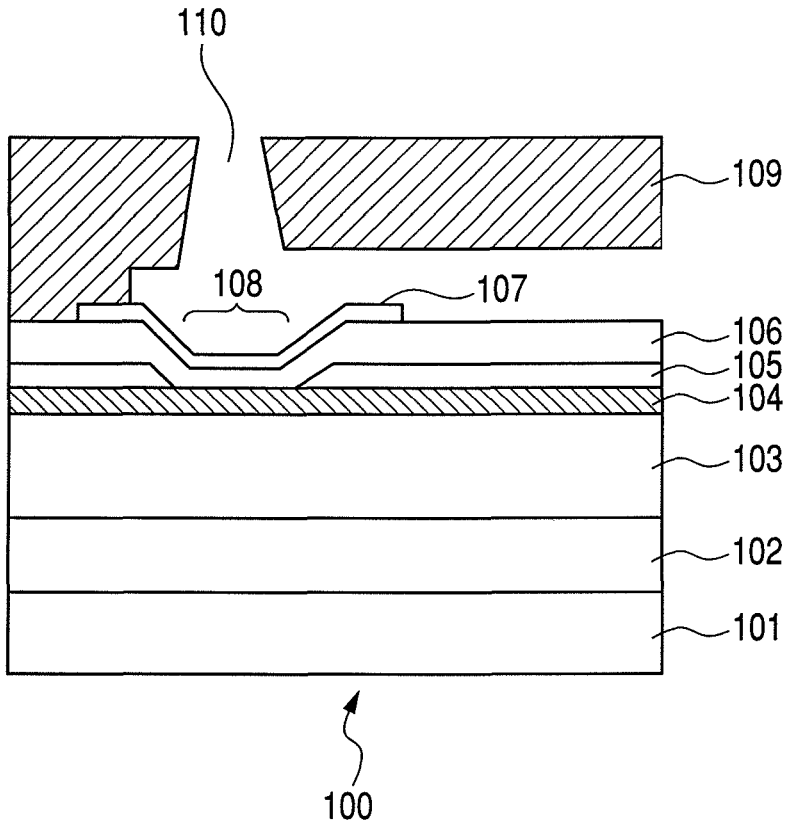
FIG. 1 is a partial sectional view of a base for a liquid discharge head according to an exemplary embodiment of the present invention.

FIG. 1 is a partial schematic view of a cut surface illustrating a liquid discharge head according to an exemplary embodiment of the present invention.

In FIG. 1, there is a base 100 for a liquid discharge head. A flow path forming member 109 made from a resin is provided on the base for the liquid discharge head. There are a silicon substrate 101, a thermal storage layer 102 made from a thermally-oxidized film, an interlayer film 103 made of an SiO film, an SiN film or the like serving as a thermal storage layer as well, and a heat generating resistive layer 104. A metal wiring layer 105 is made from a metal material such as Al, Al—Si and Al—Cu, and works as electrode wiring. A protective layer 106 is made of an SiO film, an SiN film or the like, and functions as an insulation layer as well. An upper protective layer 107 is provided on the protective layer 106, and is made from a TaSi alloy for protecting a heat generating resistive element from a chemical and physical impact due to the heat generation of the heat generating resistive element. In this way, the upper protective layer 107 is arranged in the upper part of the heat generating resistive layer 104 and the electrode wiring. A thermal action portion 108 is a portion on which heat generated in the heat generating resistive element of the heat generating resistive layer 104 acts on an ink, and constitutes a part of an ink flow path which has been formed in the inner part of a flow path forming member 109. Here, the heat generating resistive element is provided in between two metal wiring layers 105 which oppose each other at a predetermined space on the heat generating resistive layer 104, and is constituted by the heat generating resistive layer 104 which generates heat corresponding to applied electricity.

A thermal action portion 108 in the liquid discharge head is exposed to a high temperature due to heat generation of the heat generating resistive element, and also mainly receives a cavitation impact and a chemical action caused by an ink, which originate in the bubbling of ink and the retraction of the bubble after the ink has bubbled. For this reason, the upper protective layer 107 is provided on the thermal action portion 108 so as to protect the heat generating resistive element from the cavitation impact and the chemical action caused by the ink. A discharge port 110 for discharging ink is provided above the upper protective layer 107 by using the flow path forming member 109. Thus, the base for a liquid discharge head 100 is formed.

FIGS. 2A, 2B, 2C and 2D are schematic views for describing a method of forming a base 100 for a liquid discharge head according to an exemplary embodiment of the present invention.

Figure 2A:
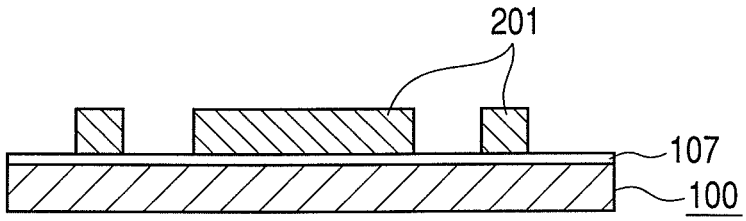
FIGS. 2A, 2B, 2C and 2D are schematic views for describing a method for forming a base for a liquid discharge head according to an exemplary embodiment of the present invention.
Figure 2B:
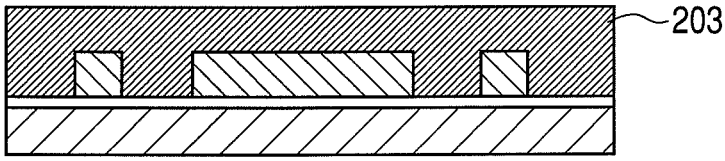
Figure 2C:
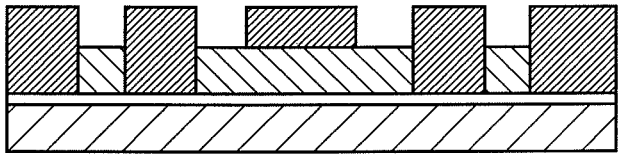
Figure 2D:
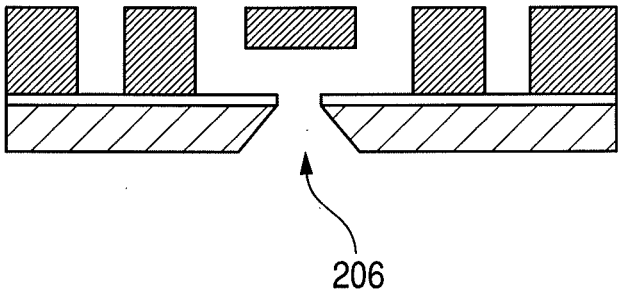

A resist is applied on an upper protective layer 107 which has been formed on a silicon substrate as a dissolvable solid layer 201 for finally forming a shape of an ink flow path with a spin coating method. This resist material is formed from polymethyl isopropenyl ketone, and acts as a negative-type resist. This resist material is patterned into the shape of the ink flow path with a photolithographic technology (FIG. 2A). Subsequently, a coating resin layer 203 is formed which is to be a flow path forming member constituting a wall of a liquid flow path and a discharge port (FIG. 2B). The upper protective layer 107 can be appropriately treated with a silane coupling agent or the like so as to enhance the adhesiveness of the coating resin layer 203 before the coating resin layer 203 is formed. A coating method for the coating resin layer 203 can be appropriately selected from among conventionally well-known coating methods, and the coating resin layer 203 can be applied on the base 100 for the liquid discharge head, on which the ink flow path pattern has been formed. Next, the coating resin 203 is patterned into desired shapes of the wall of the liquid flow path and the discharge port with a photolithographic technology. Thereby, a flow path forming member is formed from a resin (FIG. 2C). Afterwards, an ink supply port 206 is formed from a rear surface of the base 100 for the liquid discharge head with the use of an anisotropic etching method, a sand blasting method, an anisotropic plasma etching method and the like. The ink supply port 206 can be formed particularly with a chemical silicon anisotropic etching method with the use of tetramethyl hydroxyamine (TMAH), NaOH, KOH or the like. Subsequently, the dissolvable solid layer 201 is removed by exposing the whole surface with a Deep-UV ray, developing the solid layer and drying the resultant surface (FIG. 2D).

FIGS. 3A, 3B, 3C, 3D and 3E are schematic views for describing another method for forming a base for a liquid discharge head according to an exemplary embodiment of the present invention.

Figure 3A:
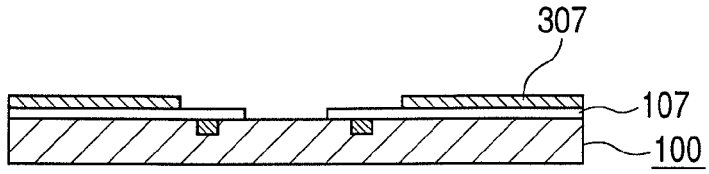
FIGS. 3A, 3B, 3C, 3D and 3E are schematic views for describing another method for forming a base for a liquid discharge head according to an exemplary embodiment of the present invention.

As is illustrated in these FIGS. 3A, 3B, 3C, 3D and 3E, an adhesion film 307 of an organic substance can also be formed in between an upper protective layer 107 and a flow path forming member 203, after a TaSi alloy ($Ta_{100-x}Si_x$ film) of the upper protective layer 107 has been formed (FIG. 3A). A polyetheramide resin was selected for the adhesion film 307. This resin has advantages of being superior in alkali-etching resistance, having adequate adhesiveness between the resin and an inorganic film made from silicon or the like, and being capable of being used as an ink protection film of a liquid discharge recording head, and accordingly can be particularly used for the adhesion film 307. Afterwards, the adhesion layer 307 is patterned, for instance, into a shape as illustrated in FIG. 3A with a photolithographic technology. The adhesion layer 307 can be patterned with a similar method to a dry-etching method for a usual organic film. Specifically, the pattern can be formed by etching the adhesion layer 307 by an oxygen-gas plasma while using a positive-type resist as a mask.

Figure 3B:
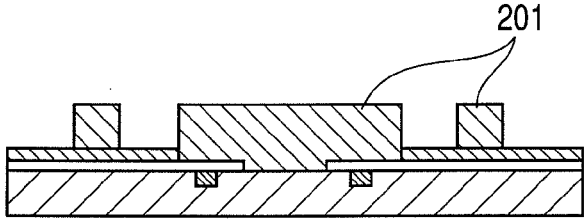

A method for forming the adhesion layer 307 after having formed the upper protective layer 107 ($Ta1_{00-x}Si_x$ film) will now be described below with reference to FIGS. 3A, 3B, 3C, 3D and 3E. A resist to become a dissolvable solid layer 201 is applied on a silicon substrate with a spin coating method so as to form a shape which will finally become an ink flow path. Then, the solid layer 201 is used as a negative resist, and is patterned into a shape of the ink flow path with a photolithographic technology (FIG. 3B).

Figure 3C:
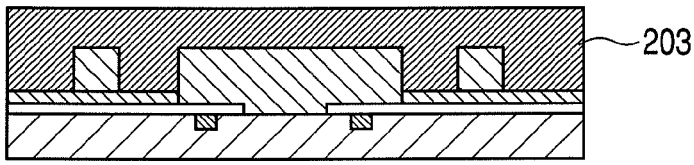
Figure 3D:
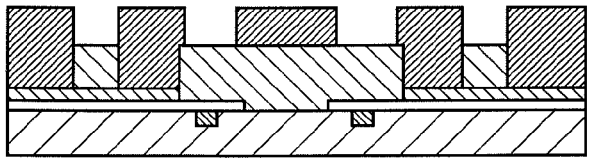
Figure 3E:
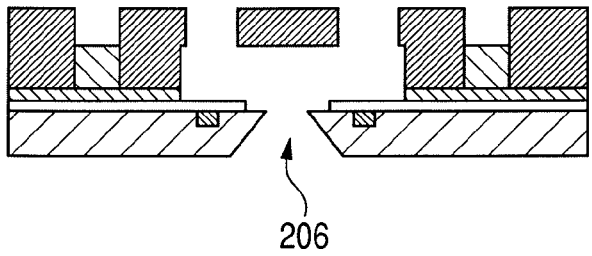

Subsequently, a coating resin layer 203 of a flow path forming member is formed so as to form a wall of a liquid flow path and a discharge port (FIG. 3C). The base can be appropriately treated with a silane coupling agent or the like so as to enhance the adhesion of the coating resin layer 203 before the coating resin layer 203 is formed. A coating method for the coating resin layer 203 can be appropriately selected from among well-known conventional coating methods, and the coating resin layer 203 can be applied on a base 100 for a liquid discharge head, on which the ink flow path pattern has been formed. The applied coating resin layer 203 is patterned with a photolithographic technology (FIG. 3D). Afterwards, an ink supply port 206 is formed from a rear surface of the base 100 for the liquid discharge head with an anisotropic etching method, a sand blasting method, an anisotropic plasma etching method and the like. The ink supply port 206 can be formed particularly with a chemical silicon anisotropic etching method with the use of tetramethyl hydroxyamine (TMAH), NaOH, KOH or the like. Subsequently, the dissolvable solid layer 201 is removed by exposing the whole surface with a Deep-UV ray, developing the solid layer and drying the resultant surface (FIG. 3E).

Thus, the base 100 for the liquid discharge head is obtained which has the flow path forming member 203 formed therein which has the discharge port and the ink flow path provided therein by the above steps described with reference to FIGS. 2A, 2B, 2C and 2D, and FIGS. 3A, 3B, 3C, 3D and 3E; and then is cut and separated into chips by a dicing saw or the like. Afterwards, the chip is electrically connected for driving a heat generating resistive element and is connected with an ink supply member to be completed into a liquid discharge head.

The upper protective layer 107 contacting the ink is required to have film characteristics superior in heat resistance, mechanical properties, chemical stability, oxidation resistance, alkali resistance and the like, and simultaneously is required to have superior adhesivenesses between itself and the adhesion layer 307 and between itself and the flow path forming member 203. Such an upper protective layer 107 is made from a TaSi alloy containing Ta and Si. Preferably, the alloy can be constituted by such a formula $Ta_{100-x}Si_x$ as to satisfy x≧22 at. %. Here, at. % is an abbreviation of atomic percent.

The film thickness of the upper protective layer 107 is selected from the range of 10 nm or more to 500 nm or less. The film stress of the upper protective layer has at least a compression stress, and can be preferably in a range of more than 0 to $1.0\times10^{10}$ dyn/cm$^2$ or less. In addition, the upper protective layer 107 can be produced with various film-forming methods, but generally, can be formed with a magnetron sputtering method which uses a high-frequency (RF) power-source or a direct-current (DC) power-source as a power source.

Figure 4:
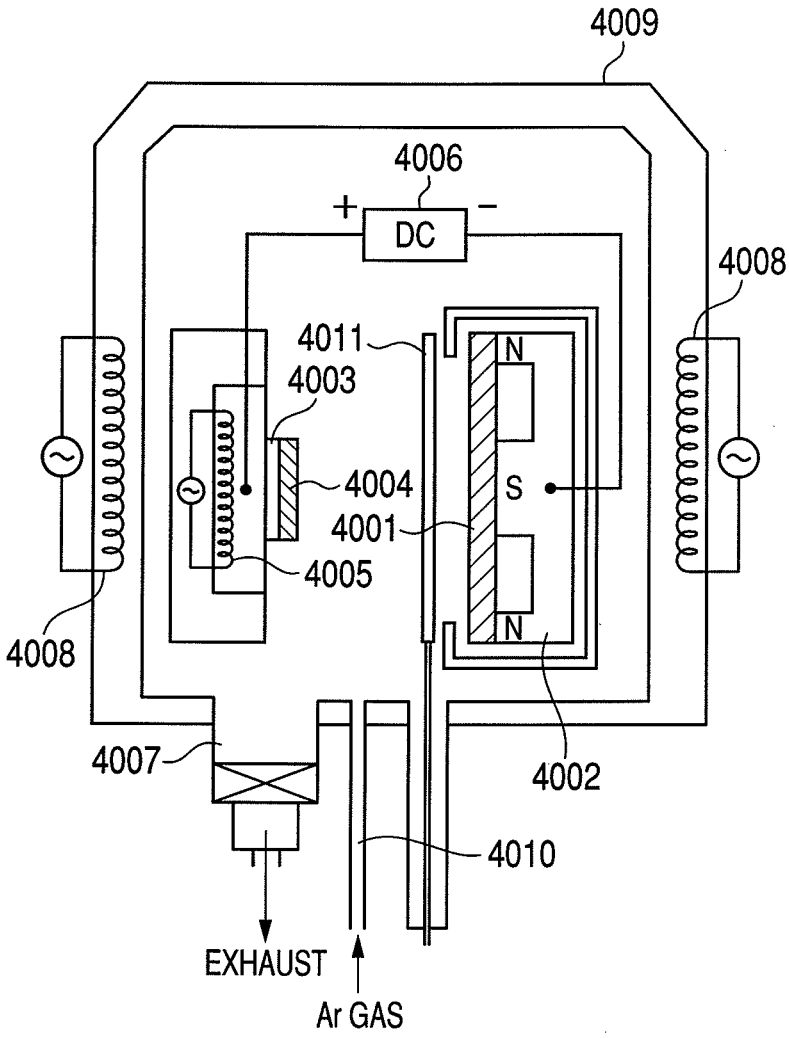
FIG. 4 is a film-forming apparatus for forming each layer of a base for a liquid discharge head according to an exemplary embodiment of the present invention.

FIG. 4 illustrates an outline of a sputtering apparatus for forming an upper protective layer 107. In FIG. 4, there are a TaSi target 4001, a flat magnet 4002, a shutter 4011 for controlling the formation of a film onto a substrate, a substrate holder 4003, a substrate 4004, and a power source 4006, which is connected to the target 4001 and the substrate holder 4003. Furthermore, in FIG. 4, an external heater 4008 is provided so as to surround the outer wall of a film-forming chamber 4009. The external heater 4008 is used for adjusting an atmospheric temperature of the film-forming chamber 4009. An internal heater 4005 for controlling the temperature of the substrate is provided on a rear face of the substrate holder 4003.

The film is formed in the following way by using the apparatus of FIG. 4. Firstly, a film-forming chamber 4009 is exhausted to $1\times10^{-5}$ Pa to $1\times10^{-6}$ Pa by using an exhaust pump 4007. Subsequently, Ar gas is introduced into the film-forming chamber 4009 from a gas introduction port 4010 through a mass flow controller (not shown). At this time, an internal heater 4005 and an external heater 4008 are adjusted so that a substrate temperature and an atmospheric temperature are set at predetermined temperatures. Next, [[a]] power is applied to a target 4001 from a power source 4006 to make the target 4001 sputter-discharge, and a shutter 4011 is adjusted so that the thin film is formed on a substrate 4004.

When an upper protective layer 107 is formed, the substrate is heated to a temperature of 100 to 300° C. to be capable of imparting a strong film adhesion to the upper protective layer 107. When the upper protective layer 107 is formed with a sputtering method which can form a particle having a comparatively-large kinetic energy, as was described above, the upper protective layer 107 can obtain a strong film adhesion.

Furthermore, when a film stress is controlled to a compression stress of $1.0\times10^{10}$ dyn/cm$^2$ or less, the upper protective layer 107 can similarly obtain a strong film adhesion. This film stress can be adjusted by appropriately setting a flow rate of Ar gas to be introduced into a film-forming apparatus, a power to be applied to a target and a heating temperature for a substrate.

Figure 5:
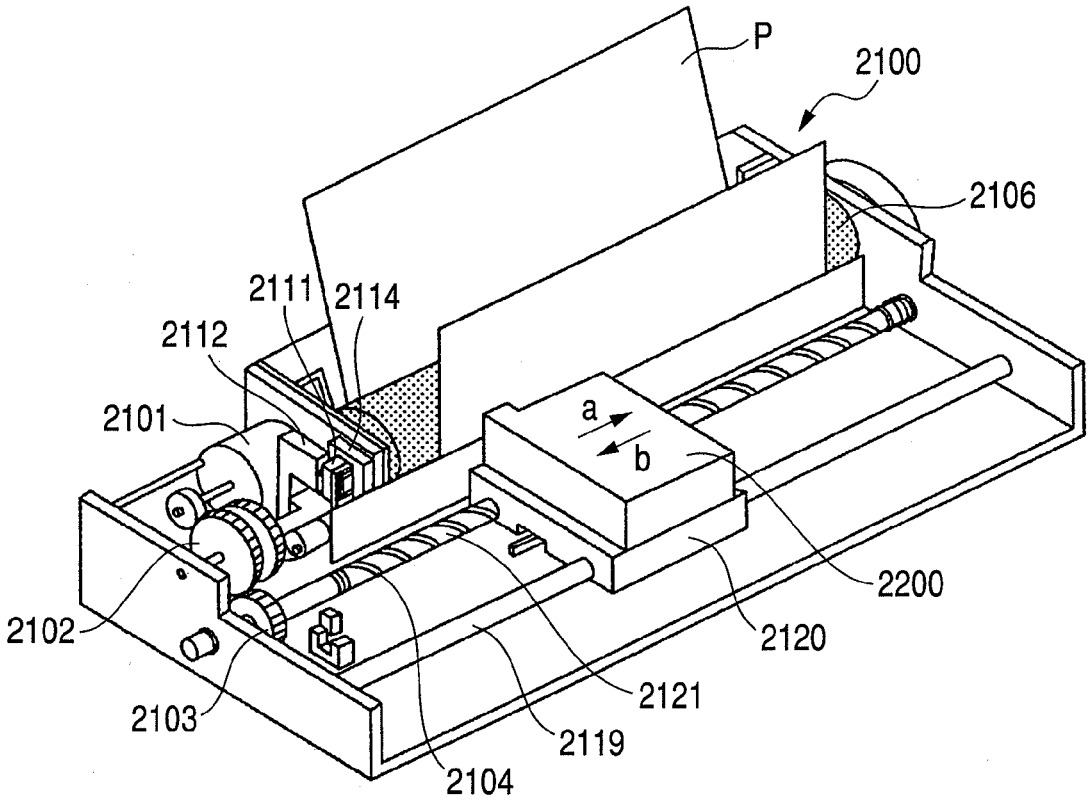
FIG. 5 is an outline drawing illustrating one configuration example of a liquid discharge recording apparatus to which a liquid discharge head according to an exemplary embodiment of the present invention is applied.

FIG. 5 is an outline drawing illustrating one configuration example of a liquid discharge recording apparatus to which a liquid discharge head according to an exemplary embodiment of the present invention is applied. This liquid discharge apparatus is an old type, but when the present invention is applied to the latest liquid discharge apparatus, and the present invention further shows the effect.

In a liquid discharge apparatus 2100 in FIG. 5, a recording head 2200 is provided on a carriage 2120 which engages with a helical groove 2121 of a lead screw 2104 that rotates in synchronization with a forward reverse rotation of a driving motor 2101 through driving-power transmission gears 2102 and 2103. The recording head 2200 is reciprocally moved by a motive power of the driving motor 2101 in directions of arrows (a) and (b) along a platen 2106 together with the carriage 2120, while being guided by a guide 2119.

A cap member 2111 caps the whole recording head 2200, and a suction unit 2112 sucks and discharges an ink in the cap member 2111. This suction unit sucks the ink into the cap member 2111 from the discharge port of the recording head, and recovers the discharge performance of the recording head 2200 by a sucking operation so as to maintain the discharge performance. A cleaning blade 2114 slides on a face on which the discharge port of the recording head is arranged, and removes the ink or the like, which deposits on the surface.

A liquid discharge recording apparatus 2100 having such a structure as described above records information on a recording paper (P) which is carried onto the platen 2106 by a recording medium supply device, while making the recording head 2200 reciprocally move across the entire width of the recording paper (P).

The present invention will now be described in detail below with reference to an example of forming upper protective layer 107 and exemplary embodiments of a liquid discharge head by using the upper protective layer and the like. However, the present invention is not limited to the exemplary embodiments.

A thin film of a TaSi alloy for the upper protective layer 107 was formed on a silicon wafer, by using the apparatus illustrated in FIG. 4 and using the above described film-forming method, and the physical properties of the film were evaluated. The film-forming operation and an evaluation method for the film properties at that time will now be described below.

[Film-Forming Operation]

Firstly, a thermally-oxidized film was formed on a single crystal silicon wafer, and this silicon wafer (substrate 4004) was set on a substrate holder 4003 in a film-forming chamber 4009 of the apparatus in FIG. 4. Subsequently, the film-forming chamber 4009 was exhausted to $8\times10^{-6}$ Pa by an exhaust pump 4007. Afterwards, Ar gas was introduced into the film-forming chamber 4009 from a gas introduction port 4010, and the inside of the film-forming chamber 4009 was set at the following conditions.

[Film-Forming Condition]

Substrate temperature: 150° C.

Atmospheric gas temperature in film-forming chamber: 150° C.

Mixture gas pressure in film-forming chamber: 0.6 Pa

Subsequently, films of $Ta_{100-x}Si_x$ with a thickness of 200 nm were formed on a thermally-oxidized film of the silicon wafer by using various TaSi targets with a sputtering method, and samples 1 to 3 were obtained.

Furthermore, films of $Ta_{100-x}Si_x$ with a thickness of 200 nm were formed similarly on the thermally-oxidized film of the silicon wafer by using a Ta target and a Si target with a binary sputtering method, and samples 4 to 12 were obtained.

[Film Physical Properties Analysis]

The above described obtained samples 1 to 3 and 4 to 12 were subjected to RBS (Rutherford back scattering) analysis, and a composition of each sample was analyzed. The results are shown in Table 1 and Table 2.

TABLE 1

| Sample number | Target composition [at. %] | Film composition [at. %] | Film stress [dyn/cm$^2$] |
|---|---|---|---|
| 1 | $Ta_{60}Si_{40}$ | $Ta_{78}Si_{22}$ | $5.5 \times 10^9$ |
| 2 | $Ta_{50}Si_{50}$ | $Ta_{65}Si_{35}$ | $4.2 \times 10^9$ |
| 3 | $Ta_{30}Si_{70}$ | $Ta_{35}Si_{65}$ | $3.5 \times 10^9$ |

TABLE 2

| Sample number | Charged power to target [W] Ta | Charged power to target [W] Si | Film composition [at. %] | Film stress [dyn/cm$^2$] |
|---|---|---|---|---|
| 4 | 700 | 129 | $Ta_{90.5}Si_{9.5}$ | $7.2 \times 10^9$ |
| 5 | 700 | 225 | $Ta_{83.3}Si_{16.7}$ | $8.2 \times 10^9$ |
| 6 | 700 | 281 | $Ta_{80.4}Si_{19.6}$ | $7.6 \times 10^9$ |
| 7 | 700 | 343 | $Ta_{77.5}Si_{22.5}$ | $5.9 \times 10^9$ |
| 8 | 700 | 416 | $Ta_{74.9}Si_{25.1}$ | $6.8 \times 10^9$ |
| 9 | 700 | 534 | $Ta_{69.1}Si_{30.9}$ | $4.8 \times 10^9$ |
| 10 | 700 | 627 | $Ta_{65.0}Si_{35.0}$ | $5.6 \times 10^9$ |
| 11 | 700 | 732 | $Ta_{59.9}Si_{40.1}$ | $4.6 \times 10^9$ |
| 12 | 700 | 943 | $Ta_{50.0}Si_{50.0}$ | $4.3 \times 10^9$ |

[Film Stress]

Subsequently, the film stress of each sample was measured based on the deformation quantity of a substrate observed before and after film formation. Samples 1 to 12 showed a compression stress of larger than 0 but $1.0\times10^{10}$ dyn/cm$^2$ or less in terms of a film stress, and thereby could provide strong film adhesion. When the film stress is a compression stress of larger than 0, the film becomes dense. When the film stress is $1.0\times10^{10}$ dyn/cm$^2$ or more, the film may possibly cause the warpage of the wafer or the crack in the film due to its large stress.

Adhesiveness with Resin

Exemplary Embodiment 1

A tape peeling test was performed after PCT (Pressure Cooker Test) so as to easily evaluate adhesiveness between a film 107 of $Ta_{78}Si_{22}$ (which expresses that a composition ratio is Ta: 78 at. % and Si: 22 at. %, and is hereafter the same) according to the present exemplary embodiment and an adhesion layer (of polyetheramide resin) 307.

The tape peeling test was carried out in the following way. An adhesion layer (polyetheramide resin) 307 was formed into a thickness of 2 μm on a silicon wafer on which an upper protective layer 107 had been formed, and grid sections with 1 mm square of 10×10=100 (length×width) pieces were formed on the adhesion layer 307 by using a craft knife. Subsequently, the sample was subjected to the PCT test on the conditions of immersing the sample in an alkaline ink at 121° C. with $2.0265\times10^5$ Pa (2 atom) for 10 hours.

Afterwards, a tape was stuck on the part of the above described grid sections, and was peeled off. Then, the number of the grids which have been peeled by the tape among 100 pieces was examined. As a result, among 100 pieces, about 23 pieces were peeled off, but the result was generally satisfactory. The result is shown in Table 3.

Comparative Example 1

The adhesiveness between a Ta film and an adhesion layer (polyetheramide resin) 307 was evaluated after the PCT, by using the same method as in exemplary embodiment 1. The result is shown in Table 3.

As is shown in Table 3, the adhesion layer 307 was peeled off from the interface between itself and the Ta film after the PCT test, which means that the adhesiveness was remarkably low.

Exemplary Embodiments 2 to 9 and Comparative Examples 2 to 4

The adhesiveness of films of $Ta_{100-x}Si_x$ having different compositions was evaluated after the PCT, by using the same method as in exemplary embodiment 1. The result is shown in Table 3.

TABLE 3

| | Film composition [at. %] | Number of peeled grids (after PCT durability test) | Sample number |
|---|---|---|---|
| Exemplary embodiment 1 | Ta78Si22 | 23/100 | 1 |
| Exemplary embodiment 2 | Ta65Si35 | 0/100 | 2 |
| Exemplary embodiment 3 | Ta35Si65 | 0/100 | 3 |
| Comparative example 1 | Ta | 100/100 | — |

TABLE 4

| | Film composition [at. %] | Number of peeled grids (after PCT durability test) | Sample number |
|---|---|---|---|
| Comparative example 2 | Ta90.5Si9.5 | 100/100 | 4 |
| Comparative example 3 | Ta83.3Si16.7 | 100/100 | 5 |
| Comparative example 4 | Ta80.4Si19.6 | 88/100 | 6 |

TABLE 4-continued

| | Film composition [at. %] | Number of peeled grids (after PCT durability test) | Sample number |
|---|---|---|---|
| Exemplary embodiment 4 | Ta77.5Si22.5 | 0/100 | 7 |
| Exemplary embodiment 5 | Ta74.9Si25.1 | 2/100 | 8 |
| Exemplary embodiment 6 | Ta69.1Si30.9 | 0/100 | 9 |
| Exemplary embodiment 7 | Ta65.0Si35.0 | 0/100 | 10 |
| Exemplary embodiment 8 | Ta59.9Si40.1 | 0/100 | 11 |
| Exemplary embodiment 9 | Ta50.0Si50.0 | 0/100 | 12 |

Figure 8:
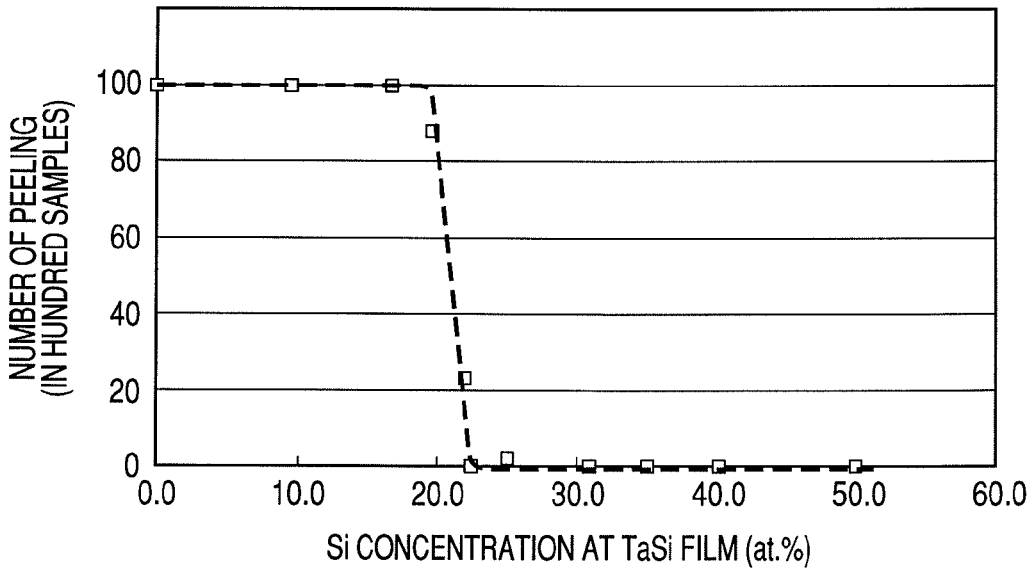
FIG. 8 is a view for describing a composition dependency of the adhesiveness to an adhesion film, while using a base for a liquid discharge head according to an exemplary embodiment of the present invention.

Adhesiveness between the upper protective layer 107 and the adhesion layer 307 (number of peeled grids) was evaluated after the PCT test, on films of $Ta_{100-x}Si_x$ of the above described exemplary embodiments and comparative examples. The result is shown in FIG. 8. As is obvious from FIG. 8, the adhesiveness showed the tendency of decreasing in a film containing little Si component. It was found that a film particularly containing 22 at. % or more x in the $Ta_{100-x}Si_x$ film showed very satisfactory adhesiveness.

The above description showed the result in the case of having an adhesion layer, but the same tendency was shown in the case of having no adhesion layer. From these results, it was elucidated that the $Ta_{100-x}Si_x$ film ($x \geqq 22$ at. %) was effective for enhancing the adhesiveness between the film and the structure provided thereon regardless of the presence or absence of the adhesion layer.

The upper protective layer 107 can preferably have the film thickness of 10 nm or more but 500 nm or less. This is because when the film thickness is less than 10 nm, the upper protective layer 107 does not sufficiently cover the lower layer of the upper protective layer 107, in the shape of an actual product. This is also because when the film thickness is 500 nm or thicker, the energy (heat) is not effectively transferred from a heat generating resistive element layer to an ink and consequently the energy loss increases.

In this way, in exemplary embodiments 1 to 9, the film even with a thickness of approximately 10 nm could provide superior adhesiveness. The film also could provide a strong adhesive force when being controlled so as to have at least compression stress of larger than 0 but $1.0\times10^{10}$ dyn/cm$^2$ or less in terms of film stress.

In exemplary embodiments 1 to 9 as described above, when a resin (flow path forming member 109) was formed on the upper part of the upper protective layer 107, the resin was adequately fixed on the upper protective layer 107. The employment of such an upper protective layer enabled the provision of a base for a liquid discharge head which can have longer length and higher density, and a liquid discharge head using the base.

Exemplary Embodiment 10

A liquid discharge head was completed by using a single layer film of $Ta_{65}Si_{35}$ as an upper protective layer 107, and was made to actually discharge ink, and then, the discharge state was evaluated.

In the present exemplary embodiment, a $Ta_{65}Si_{35}$ film with the film thickness of 230 nm was formed on an insulation film by using a $Ta_{50}Si_{50}$ target with a sputtering process.

Afterwards, the $Ta_{65}Si_{35}$ film was pattern-formed with the use of a general photolithographic process, according to the sequential steps of forming a pattern of a resist (applying, exposing and developing the resist), etching the $Ta_{65}Si_{35}$ film and stripping the resist. At this time, a pattern shape of the $Ta_{65}Si_{35}$ film can be formed into a desired pattern by selecting a pattern of a photo mask to be used when the resist is exposed.

Then, a dissolvable solid layer 201 was applied onto a substrate which included an upper protective layer 107 formed on a silicon substrate 101, with a spin coating method, and was exposed to form a shape to be an ink flow path. The shape of the ink flow path could be obtained by using a normal mask and a Deep-UV ray. Then, a coating resin layer 203 was stacked thereon, was exposed with an aligner, and was developed to form a discharge port 110. Subsequently, an ink supply port 206 was formed by a chemical silicon anisotropic etching method with the use of TMAH. Then, the whole surface of the coating resin layer 203 was irradiated with the Deep-UV ray, was developed and dried. Thus, a portion to be dissolved of the coating resin layer 203 was removed. By the above steps, the discharge port 110 and a flow path forming member 109 having the ink flow path formed therein were completed. The base 100 for the liquid discharge head on which the flow path forming member 109 had been formed was cut and separated into chips by a dicing saw or the like. Then, the chip was electrically connected for driving a heat generating resistive element and was connected with an ink supply member to be completed into a liquid discharge head.

The discharge performance was evaluated by making the liquid discharge head which had been prepared here discharge an alkaline ink with pH 10. As a result, an adequate image record could be obtained. The discharge performance was also evaluated by immersing the liquid discharge head in the ink at 60° C. for 3 months and discharging ink. As a result, a print of adequate record quality could be obtained, and the peeling of the coating resin layer 203 was not confirmed.

In addition, the discharge durability of the above described liquid discharge head was tested. In the test, the lifetime of the liquid discharge recording head was examined by making the liquid discharge recording head continuously discharge ink at a driving frequency of 5 KHz with a pulse width of 1μ sec, until the liquid discharge recording head could not discharge any more. As a result, a liquid discharge head having a $Ta_{100-x}Si_x$ film of which the (x) was 70 at. % or less could show adequate durability, and a liquid discharge head having a $Ta_{100-x}Si_x$ film of which the (x) was 50 at. % or less could show more adequate durability.

Exemplary Embodiment 11

Figure 6:
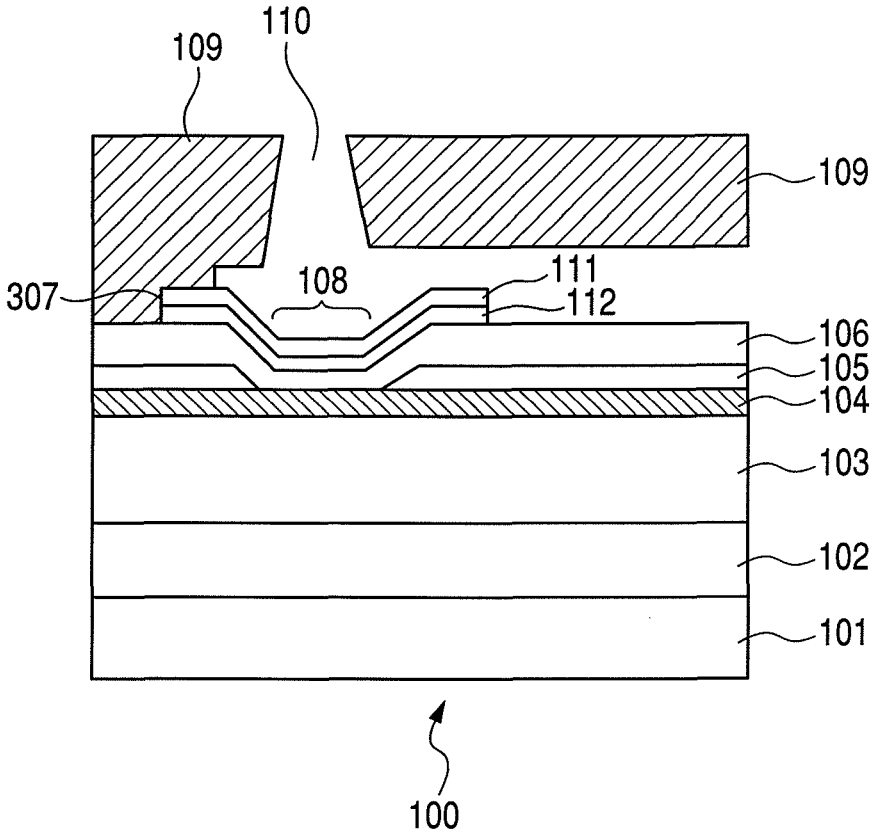
FIG. 6 is a schematic view for describing further another method for forming a base for a liquid discharge head according to an exemplary embodiment of the present invention.
Figure 7:
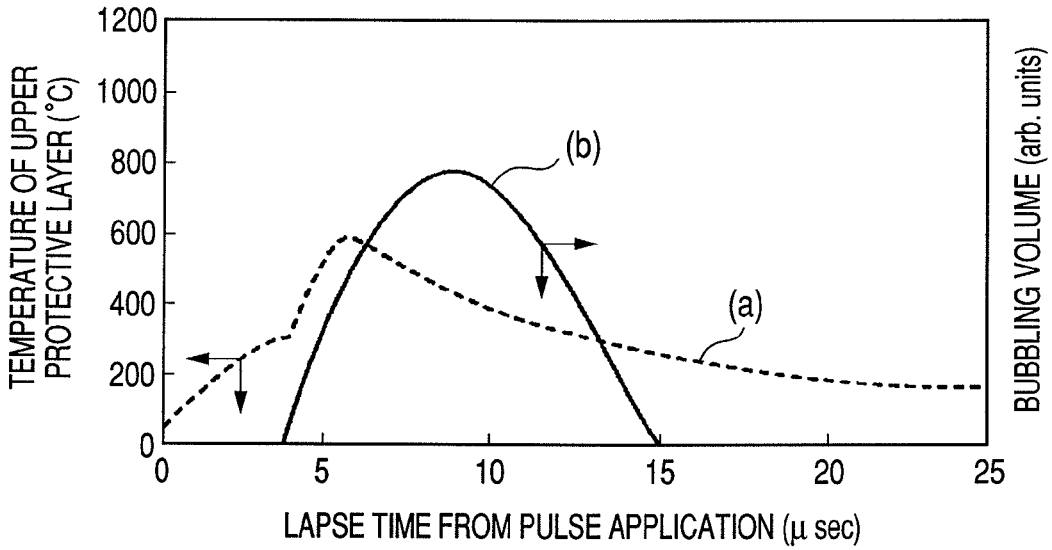
FIG. 7 is a view for describing a temperature change of an upper protective layer and a bubbling state after a voltage has been applied.

FIG. 6 is a schematic view for describing further another method for forming a base for a liquid discharge head according to an exemplary embodiment of the present invention.

The base for the liquid discharge head in the exemplary embodiment described here has a Ta layer provided under an upper protective layer 111, as is illustrated in FIG. 6. The layer in a thermal action portion is constituted by the upper layer 111 made from TaSi and the lower layer 112 made from Ta.

Specifically, the present exemplary embodiment will show the case in which a $Ta_{65}Si_{35}$ film is used as the upper protective layer 111 and the Ta film is used as the lower layer 112.

As the lower layer 112, the Ta film with the film thickness of 220 nm was formed on an insulation film by using a Ta target with a sputtering process. Then, as the upper layer 111, a film having composition of $Ta_{65}Si_{35}$ with the film thickness of 100 nm was formed on the lower layer 112 by using a $Ta_{50}Si_{50}$ target with a sputtering process.

Afterwards, the film formed of 2 layers of the $Ta_{65}Si_{35}$ film and the Ta film was pattern-formed with the use of a general photolithographic process, according to the sequential steps of forming a pattern of a resist (applying, exposing and developing the resist), etching the $Ta_{65}Si_{35}$ film and the Ta film and stripping the resist. Here, the $Ta_{65}Si_{35}$ film and the Ta film were continuously dry-etched.

At this time, a pattern shape of the $Ta_{65}Si_{35}$ film and the Ta film can be formed into a desired pattern by selecting a pattern of a photo mask to be used when the resist is exposed.

Afterwards, the liquid discharge head was completed by the same steps as in exemplary embodiment 10, and the discharge performance was evaluated by making the liquid discharge head discharge an alkaline ink with pH 10. As a result, an adequate image record could be obtained. The discharge performance was also evaluated by immersing the liquid discharge head in the ink at 60° C. for 3 months and discharging ink. As a result, a print of adequate record quality could be obtained, and the peeling of a coating resin layer 203 was not confirmed.

Exemplary Embodiment 12

An exemplary embodiment described here shows a case where a gradient composition film of TaSi is employed as an upper protective layer 107. Specifically, the upper protective layer 107 forms a gradient composition film in which the content of Si increases toward a coating resin layer 203 from a heat generating resistive layer 104. As for the composition ratio of Ta to Si in the upper protective layer 107, a surface contacting the coating resin layer 203 which is a flow path forming member can preferably contain more Si than a surface contacting the heat generating resistive layer 104. At this time, the upper protective layer 107 shows more advantages in the adhesiveness.

In the present exemplary embodiment, the upper protective layer was formed by employing a binary sputtering process with the use of a Ta target and a Si target and varying each of a Ta sputtering power and a Si sputtering power. The TaSi film was formed into the film thickness of 230 nm, of which the film composition was continuously varied in a film-forming direction, by charging firstly a power of 700 W only to the Ta target, then increasing the power of the Si target in a state of fixing the power of the Ta target, and finally varying the power of the Ta target to 700 W and the power of the Si target to 600 W. Thereby obtained film showed a gradient composition in which the content of Si increased toward $Ta_{66}Si_{34}$ in the coating resin layer 203 side from Ta in the heat generating resistive layer 104 side. Here, the film composition was continuously varied, but may be varied stepwise.

The liquid discharge head was completed with the use of the above described protective film 107 by the same steps as in exemplary embodiment 10, and the discharge performance was evaluated by making the liquid discharge head discharge an alkaline ink with pH 10. As a result, an adequate image record could be obtained. The discharge performance was also evaluated by immersing the liquid discharge head in the ink at 60° C. for 3 months and discharging ink. As a result, a print of adequate record quality could be obtained, and the peeling of the coating resin layer 203 was not confirmed.

Comparative Example 5

Comparative examples of exemplary embodiments 10 to 12 will be shown below, in which a single film made from only Ta is used as an upper protective layer.

In the present comparative example, a Ta film was formed into the thickness of 230 nm by using a Ta target with a sputtering process, and a liquid discharge head was completed in the same way as in exemplary embodiment 10.

Then, the discharge performance was evaluated by making the liquid discharge head discharge an alkaline ink with pH 10. As a result, an adequate image record could be obtained. However, as a result of having evaluated the discharge performance after having immersed the liquid discharge head in the ink at 60° C. for 3 months and discharged ink, a portion was observed, at which the ink was not discharged, and a print of adequate record quality could not be obtained. When the liquid discharge head was observed, the peeling of a coating resin layer 203 was observed, and a portion was confirmed, in which ink flow paths were communicated with each other, though the ink flow paths should be originally independent from each other in the portion.

Exemplary Embodiment 13

Figure 9:
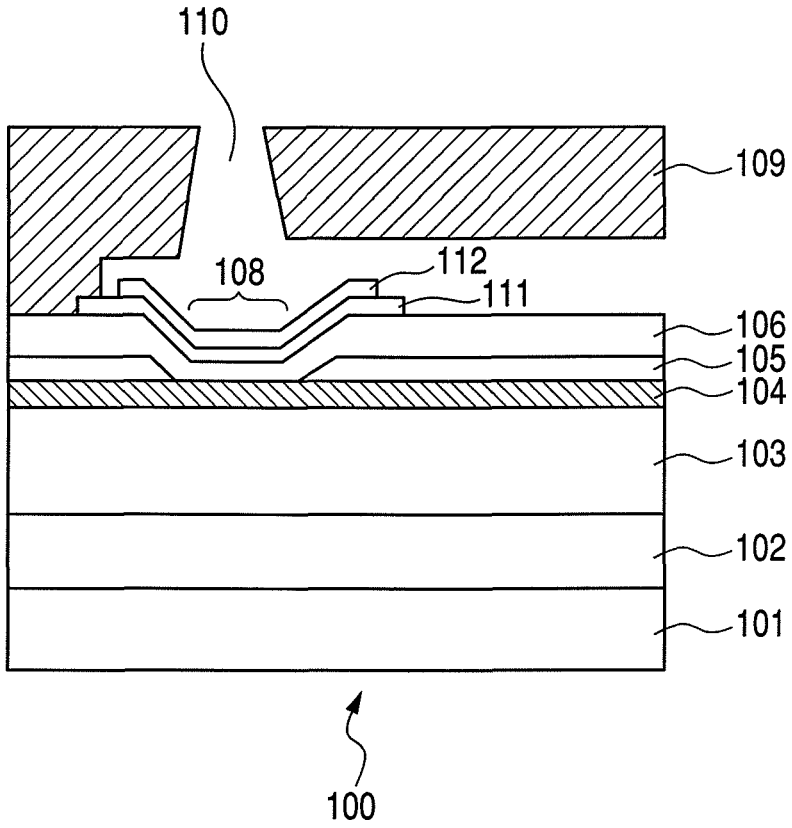
FIG. 9 is a schematic view for describing further another method for forming a base for a liquid discharge head according to an exemplary embodiment of the present invention.

FIG. 9 is a schematic view for describing still another method for forming a base for a liquid discharge head according to an exemplary embodiment of the present invention.

In the exemplary embodiment described here, there is a two-layer structure in which a Ta layer 112 is provided on the further upper layer of an upper protective layer 111 that corresponds to a heat generating resistive element, as is illustrated in FIG. 9. Thus, the layer in the thermal action portion is constituted by an upper layer 112 made from Ta and a lower layer 111 made from TaSi.

Specifically, the present exemplary embodiment will show the case in which a Ta film is used as the upper layer film 112 of an upper protective layer 107 and a $Ta_{69.1}Si_{30.9}$ film is used as the lower layer film 111.

As the TaSi film 111, the $Ta_{69.1}Si_{30.9}$ film having the film thickness of 100 nm was formed on an insulation film by using a Ta target and a Si target with a binary sputtering process. Afterwards, the Ta film 112 was formed into the thickness of 200 nm by using a Ta target with a sputtering process.

Afterwards, the film formed of 2 layers of the Ta film and the $Ta_{69.1}Si_{30.9}$ film was pattern-formed with the use of a general photolithographic process, according to the sequential steps of forming a pattern of a resist (applying, exposing and developing the resist), etching the Ta film and the $Ta_{69.1}Si_{30.9}$ film and stripping the resist.

At this time, a flow path forming member can be preferably formed so as not to coincide with the Ta film, and the flow path forming member can be preferably formed on the $Ta_{69.1}Si_{30.9}$ film. Such a pattern shape can be formed into a desired pattern by selecting a pattern of a photo mask to be used when the resist is exposed.

Afterwards, the flow path forming member 109 is formed so as to coincide with one part of the $Ta_{69.1}Si_{30.9}$ film 111 through the same steps as in exemplary embodiment 10. The flow path forming member could enhance its adhesiveness by being formed on the $Ta_{69.1}Si_{30.9}$ film 111 as in the present structure. On the other hand, the same durability as in a conventional film could be obtained by employing the Ta film as the upper layer film 112 contacting with an ink. Next, the discharge performance was evaluated by completing the liquid discharge head and discharging an alkaline ink with pH 10. As a result, an adequate image record could be obtained. The discharge performance was also evaluated by making immersing the liquid discharge head in the ink at 60° C. for 3 months and discharging ink. As a result, a print of adequate record quality could be obtained, and the peeling of a coating resin layer 203 was not confirmed.

Etching Rate of Film Obtained in the Present Embodiment

The samples were prepared, which had a photo resist patterned into a predetermined shape formed on metal films having each composition formed in exemplary embodiments 1 to 3 of Table 3. Each of the above samples was dry-etched by using a reactive ion etching apparatus, introducing $Cl_2$ gas therein at a flow rate of 100 sccm until the pressure reached 1 Pa, and charging the power of 500 W. As a result, it was found that the etching rate tended to increase as the Si content increased, but the etching rates of the films of exemplary embodiments 1 to 3 were approximately 200 to 300 nm/min, and did not depend so much on the composition. In contrast to this, in the case of TaCr which is disclosed in U.S. Pat. No. 7,306,327, the etching rate in a dry etching process depends on a Cr content. The etching rate drastically decreases as the Cr content increases, and thus greatly depends on the composition. The etching rate of TaSi according to the present invention is less sensitive to the composition, and is clearly different from that of TaCr.

In the exemplary embodiments 10 to 13 described above, a TaSi film was formed on the surface contacting with a flow path forming member 109 of an upper protective layer 107 on a base 100 for a liquid discharge head. According to these exemplary embodiments, when the base for the liquid discharge head was used in a printer which had small dots so as to cope with the tendency of higher definition for a recording image, or in a printer which coped with high speed printing, for instance, when the base was lengthened into 1.0 inch or longer, or when the base for the liquid discharge head was used in a printer using various inks, the adhesiveness between the upper protective layer and a resin layer for forming a liquid flow path was improved. In addition, as was shown in exemplary embodiment 14, the TaSi film according to the present invention can be etched without greatly depending on the composition by using a dry etching process, and can be patterned by using an existing apparatus. As a result, the present invention could provide a base for a liquid discharge head which enables a printer to cope with higher density, and a liquid discharge head using the base for the liquid discharge head.

A liquid discharge head described in the above exemplary embodiments had a flow path forming member such as a discharge port and an ink flow path formed with a photolithographic technology, but the present invention is not limited to the above liquid discharge head, and includes another liquid discharge head made by separately structuring a top plate that forms an orifice plate which becomes a discharge port and an ink flow path, and placing these components on the upper protective layer by using an adhesive or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-320954, filed Dec. 12, 2007, which is hereby incorporated by reference herein in its entirety.

The invention claimed is:

1. A base for a liquid discharge head having a flow path forming member made from a resin provided thereon, the base comprising:

a heat generating resistive element for generating energy for discharging a liquid;

an electrode wire that is electrically connected to the heat generating resistive element;

an insulative protective layer provided on or above the heat generating resistive element and the electrode wire; and an upper protective layer provided on or above the insulative protective layer, wherein the upper protective layer is made from a TaSi alloy containing 22 at. % or more Si.

2. The base for the liquid discharge head according to claim 1, further comprising an adhesion layer containing an organic substance between the flow path forming member to be provided on the base and the upper protective layer, the adhesion layer being in contact with the upper protective layer.

3. The base for the liquid discharge head according to claim 1, wherein the upper protective layer has a film thickness of 10 nm or more but 500 nm or less.

4. The base for the liquid discharge head according to claim 1, wherein a film stress of the upper protective layer is a compression stress of more than 0 but $1.0\times10^{10}$ dyn/cm$^2$ or less.

5. The base for the liquid discharge head according to claim 2, wherein the adhesion layer is a polyetheramide resin.

6. The base for the liquid discharge head according to claim 1, wherein the upper protective layer is made from a TaSi alloy containing 70 at. % or less Si.

7. The base for the liquid discharge head according to claim 1, wherein a Ta layer is provided on the upper protective layer at a location corresponding to the heat generating resistive element.

8. The base for the liquid discharge head according to claim 1, wherein a Ta layer is provided under the upper protective layer.

9. The base for the liquid discharge head according to claim 1, wherein the upper protective layer is made from a TaSi alloy in which a Si content increases toward the flow path forming member from the base, and contains 22 at. % or more Si but 70 at. % or less Si at a portion contacting the flow path forming member.

10. A liquid discharge head comprising:

the base for the liquid discharge head according to claim 1, and the flow path forming member provided on the base for the liquid discharge head, the flow path forming member having a discharge port for discharging the liquid formed therein, and being in contact with the upper protective layer.

* * * * *